METHOD OF FORMING MULTICOLOR IMAGES

This application is a continuation of application Ser. No. 13,200, filed Feb. 9, 1987, now abandoned; which is a continuation of application Ser. No. 770,302, filed Aug. 27, 1985, now abandoned; which, in turn, claims the priorities of Japanese Nos. 181,087/84 and 181,550/84, both filed Aug. 30, 1984.

BACKGROUND OF THE INVENTION

1. Field of the Invention

The present invention relates to a method of forming images such as multi-color images and, more particularly, to a multi-color forming method of superposing a plurality of toner images of different colors on an electrostatic photosensitive member by repeating a plurality of times an image forming process including at least charging, image exposing and toner developing steps.

2. Description of the Prior Art

There is known a color image forming method which uses an electrophotographic system so as to form electrostatic latent images in multi-color images.

According to this system of the prior art, the light from an original document has its colors separated through an optical filter, and the charging, exposing, developing and transferring steps are repeated for each of colors separated. Specifically, these steps are repeated three or four times so as to form images of respective colored particles (i.e., colored toners) of yellow, magenta and cyan colors, and a black color, if necessary. There is also the so-called "dichromatic developing method" by which electrostatic latent images of different polarities are formed on a common photosensitive member (i.e., image retainer) and developed with black- and red-colored particles. These multi-color image forming methods are desirable because they can add color information in addition to the information which is obtained from an image of white and black colors only, but are accompanied by the following problems:

(1) Since each image has to be transferred to transfer members each time development of each color is ended, the machine is large, and the considerable time is required to form the image.

(2) It is necessary to guarantee the precision because of registration error due to repeated operation.

In view of these problems, attempts have been made to reduce the size of the machine by developing a plurality of toner images on a commo photosensitive member so that the transfer step may be conducted one time.

According to this image forming method, it is sufficient to repeat several times the subsequent developments of the photosensitive member which has already been formed with the toner images. However, this method is accompanied by a problem that the toner images formed in advance on the photosensitive member at preceding steps are disturbed during the succeeding development, or that the toners existing already on the photosensitive member are returned to a developer carrier, so that they are mixed into a succeeding developing device reserving a toner of a color different from those of the preceding developing agents thereby to invite somberness. In order to eliminate that problem, there has been proposed a method in which a photosensitive member and the developer layer on its carrier are held out of contact except in a developing device for first forming a toner image on the photosensitive member and in which an a.c. component is superposed on a developing bias to be applied to the developer carrier or the photosensitive member.

The principle of the aforementioned image forming method will be explained with reference to FIG. 1. This Figure is a flow chart showing changes in the potential on the photosensitive member.

First of all, the photosensitive member is charged to a constant potential by means of a scolotron charger o the like. The explanation will be continued in the following by taking up the case in which the charging polarity is positive. If the photosensitive member (as shown in FIG. 1 ①) charged as above is exposed to an image, its optically irradiated part PH has its potential dropped (as shown in FIG. 1 ②). "DA" indicates an area left unexposed. Next, by applying a bias having a d.c. component substantially equal to the potential of the unexposed part DA to a developing device in the first stage, the positively charged toner $T_1$ in the developing device sticks to the exposed part PH having a relatively low potential so that a first visible image is formed (as shown in FIG. 1 ③). As a result that the positively charged toner sticks, the corresponding part has its potential raised slightly (as indicated at DUP in the same Figure). Next, the photosensitive member is charged again uniformly by a charger, including the part having the toner $T_1$ (as shown in FIG. 1 ④). Next, a second image exposure is conducted (as shown in FIG. 1 ⑤), followed by a development like the above. Then, another toner $T_2$ sticks to the exposed part PH so that a second visible image is formed (as shown in FIG. 1 ⑥). If these steps are repeated four times, for example, toner images of four colors are formed on a drum of photosensitive member. These toner images are transferred to a sheet of recording paper and then fixed to form a record. On the other hand, the surface of the photosensitive member is cleaned.

In the systems described above, the second and later charging steps can be omitted. If the charging steps are not omitted, a statically eliminating step may be incorporated before the charging steps.

In the explanation of the image forming method described above, there is taken up the case in which a reversing phenomenon of applying the toners to the exposed part of the photosensitive member is used. However, this image forming method can be practised even if the normal phenomenon of applying the toners to the unexposed part is used.

Here, an arbitrary color can be expressed on principle by the yellow, magenta and cyan (i.e., primaries) toners, and it is unnecessary to add a black toner. In the ordinary record, however, black is frequently emphasized more than other colors because they are used to express sharp parts such as letters or lines. Generally speaking, in order to express black in the primaries, moreover, it is required to strictly register the toner images of three kinds and to make the spectral transmissivities of the respective toners approximately ideal. However, these requirements are technically difficult to satisfy. Moreover, the density of the recorded image composed of the primaries is adversely affected. In order to eliminate those problems, therefore, the aforementioned image forming method is frequently practised by a developing device reserving the black toner in addition to those for the primaries.

The following two systems exist in case various colors are expressed by the methods described above:

(1) A system in which toners of different colors are not superposed directly one on the other; and (2) The system in which toners of different colors are superposed one on the other.

According to the system (1), a color mixing is substantially caused on the recording paper by not superposing but distributing the multi-color toners $T_1$ and $T_2$ on a photosensitive member 1, as shown in FIG. 2(A). According to the system (2), toners of different colors are developed in a superposed manner on a toner image of a certain color by controlling a latent image potential and a developing bias.

In system (1), however, it is necessary to strictly register the image exposure so that the toner images of the respective colors may not be superposed in the common positions. If an image exposing ray L is so incomplete as is shown in FIG. 2(B), the toner image $T_1$ of the preceding stage blocks the image exposing ray L partially to raise a problem that the applied amount of the toner $T_2$ to be developed at the succeeding stage is so remarkably reduced as is shown in FIG. 2(C). This problem makes it impossible to establish color mixing of a desired tone. In the system (2), on the other hand, even if the toner $T_1$ developed before is irradiated with a ray, this ray is absorbed by the toner $T_1$ so that the latent image is not formed completely. As a result, the applied amount of the toner $T_2$ developed later is so remarkably reduced as is shown in FIGS. 3 or 4.

As the multi-color image forming method described above, moreover, there are known methods which are disclosed in Japanese Patent Laid-Open Nos. 56-144452, 58-116553, and 58-116554. According to all these methods, the image exposures repeated are conducted by different apparatus so that the subsequent image exposure position has to be shifted not to be superposed on the previous image exposure position. Moreover, development is performed by applying such a toner to an electrostatic image corresponding to the exposure part and having a lower potential than the background potential so as to charge the same with the same polarity. If the image exposure is conducted to form a multi-color image such as a landscape image by means of a spot-distributed exposure using a laser beam scanner, for example. This raises the problem that the spot distribution density is made coarser to form only such a multi-color image as is seen rough and faded. Other problems are that the recording device is large thereby increasing manufacturing costs, and that the synchronous control of the exposure of the image retainer to the image is complicated because it is related to the position of the image exposure device.

SUMMARY OF THE INVENTION

An object of the present invention is to provide a method by which an image having an excellent color balance with no disturbance can be easily formed.

According to the present invention, there is provided an image forming method comprising: the step of developing a latent image, which is formed by subjecting an image retainer having a photoconductive layer to a first image exposure, with first toner; and the step of developing a latent image, which is formed by a second image exposure, with second toner, wherein the improvement resides in that the transmissivity of said first toner is sufficiently high for an irradiating ray used for said second image exposure.

The irradiating rays to be used in the first and second image exposures may be generated by a common light source or by separate light sources.

Another object of the present invention is to provide a multi-color image forming method which is enabled to record a multi-color image such as a landscape image densely and finely, to make a recording device that is both small and economical and to facilitate the synchronous control of the image exposures.

In order to form a multi-color image most simply, it is sufficient on principle to repeat the process a desired number of times including charging, image exposing and developing steps thereby to superpose toner image of different colors on an electrostatic photosensitive member (which will be shortly referred to as the "photosensitive member"). One of the most important factors for making that practically difficult to make it necessary to adopt the aforementioned complicated methods is that the toner image formed previously on the photosensitive member shields the ray of the subsequent image exposure to obstruct the image formation at the image-superposed part of the photosensitive member. This state is shown schematically in FIG. 12.

FIGS. 12(A) and 12(B) show the case in which the so-called "normal development" is conducted by applying the toner to the charge-holding part left unexposed to form a positive image to the exposing ray. FIGS. 12(C) and 12(D) show the case of the so-called "reversal development", in which the toner is applied by changing the charge of the developer and the bias voltage for the development to such a part of the photosensitive member as has its charge dropped as a result of the exposure to give a negative image to the exposure. As shown, the positions of solid lines indicate the potential E on the surface of the photosensitive member, and an abscissa indicates the location on the photosensitive member.

In the case of the normal development, the charges (as shown in FIG. 12(A) - (1)) given to all over the surface of the photosensitive member by the first charging action are dropped as shown in FIG. 12(A) - (2) except unexposed for parts b and d so that the toner $T_1$ is applied to the parts b and d by the first development to form an image of a first color. In case the charges are then applied again to the whole surface by a second charging action (as shown in FIG. 12(A) - (4)) and in case parts a, b, c, e and g are exposed to an image, all the potentials of the exposed parts are dropped, as shown in FIG. 12(A) - (5), so as to form a correct color image. Even in case the images of different colors formed with the toners $T_1$, $T_1+T_2$, and $T_2$, as shown in FIG. 12(A) - (6), are those to be formed on the parts b, d and f, no potential drop occurs (as shown in FIG. 12(B) - (5)) at the part b formed already with the image of the toner $T_1$, in case the ray is absorbed by the toner $T_1$ layer so that the toner $T_2$ is applied (as shown in FIG. 12(B) - (6)) by the second development to not only the unexposed parts d and f but also the part b. As a result, the image of the color of the toners $T_1+T_2$ is also formed on the part b which should be formed with the image composed of the toner $T_1$ only.

In the case of the reversal development, on the other hand, a part having been subjected to a first development and formed with the image of a toner $T_3$ has its potential dropped already when a second exposure is given, as shown in FIG. 12(C) - (5). After a second development with a toner $T_4$, as shown in FIG. 12(C) - (6), the part x has its potential dropped only slightly due to the optical absorption by the toner $T_3$, as shown in FIG. 12(D) - (5), even in case an image to be composed of the superposed images of the toners $T_3$ and $T_4$, so that the second toner $T_4$ is not applied or only a little applied. As a result, only a monochromatic image of the toner $T_3$ is formed on the part x which is to be subjected to the first and second exposures and formed with the mixed color image of the toners $T_3$ and $T_4$.

In order to solve the problems described above, we have conducted investigation noting the spectral reflectivities of the toners to reach the present invention.

Those problems are solved by a multi-color image forming method for superposing a plurality of toner images of different colors on an electrostatic photosensitive member by repeating a plurality of times an image forming process including at least the charging, image exposing and toner developing steps, wherein the improvement resides in that there is used for said image exposure a ray which has such a wavelength distribution as to substantially transmit the respective toners composing a toner image formed already on said electrostatic photosensitive member when in said image exposure, and which more particularly has a spectral distribution peak in the wavelength range in which said toners exhibit a reflectivity of 40% or more.

As has been described hereinbefore, those problems are occur as a result of the block of the ray by the toner layer which has already been formed on the surface of the photosensitive member before the exposure It is, however, dificult in many respects to directly measure the effective amount of light transmitted to reach the photosensitive member lying just below the layer formed by an optically scattering member such as the toner. Our investigations have revealed that the reflectivity has a correlation with the effective amount of the exposing ray under the aforementioned practical conditions, i.e., the effective amount of the light transmitted. Therefore, the reflectivity of the toner layer to be defined in the present invention can be interpreted to have the meaning identical to the effective transmissivity.

According to the present invention, more specifically, by using as the exposing ray the ray which has a high transmissivity to the toner layer formed already on the photosensitive member, the ray is caused to reach even the photosensitive member covered with that toner layer thereby to form the superposed toner images.

Incidentally, since each toner image is usually formed of one or two layers of toner particles, the reflectivity has a value which is measured by the use of a sample having one generally uniform layer of toner particles.

As a suitable amount of toner is scattered by means of a spoon on the adhesive surface of the "Mitac label", which is known as a product of Nichiban KK and is flattened by the finger of the operator, its surplus is removed from such a region of the adhesive surface as is to be formed into a desired toner-applied part. If necessary, the above-specified label is cleaned. That region is required to have a diameter of 30 mm or more for the convenience of the meter.

Moreover, the desired sample is prepared by rubbing lightly with the finger until the toner no longer adheres to the finger.

The sample thus prepared is measured as to its spectral specific reflectivity by means of the Spectro Photometer 330 made by Hitachi Ltd.

The method of the present invention can be applied to the formation of a multi-color image combined of toners of arbitrary colors but can be used especially preferably for forming the so-called "full-color image" using the yellow, magenta and cyan toners.

The other objects and features of the present invention will be made apparent from the following description with reference to the accompanying drawings.

BRIEF DESCRIPTION OF THE DRAWINGS

In FIGS. 1 to 4 showing the example of the prior art:

FIG. 1 is a flow chart showing the image forming steps;

FIGS. 3 and 4 are sectional views showing the toner-applied states for forming another image.

In FIGS. 5 to 11 showing an embodiment of the present invention:

FIG. 5 is a schematic section showing an image forming apparatus;

FIG. 6 is a sectional view showing a developing device;

FIG. 7 is a graph showing the optical transmissivities to an irradiating ray for respective toners;

FIG. 10 is a graph showing the density characteristics under respective developing conditions in case the field intensity and the frequency are changed; and FIG. 11 is a time chart of the steps of forming the image;

DESCRIPTION OF THE PREFERRED EMBODIMENTS

The present invention will be described in detail in the following in connection with the embodiments thereof with reference to FIGS. 5 to 11.

Figure 3:
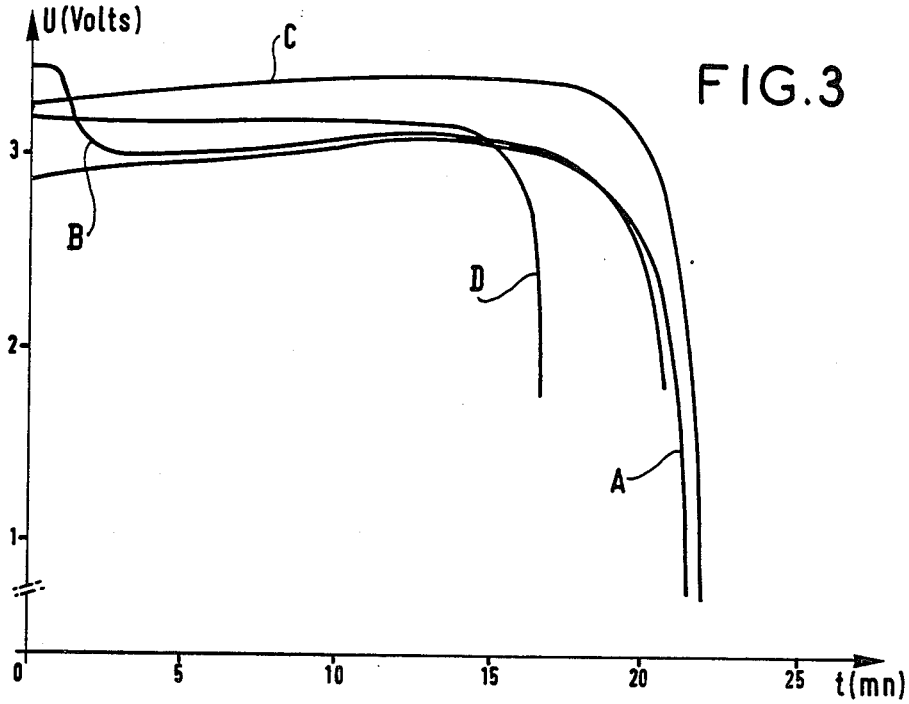
Figure 4:
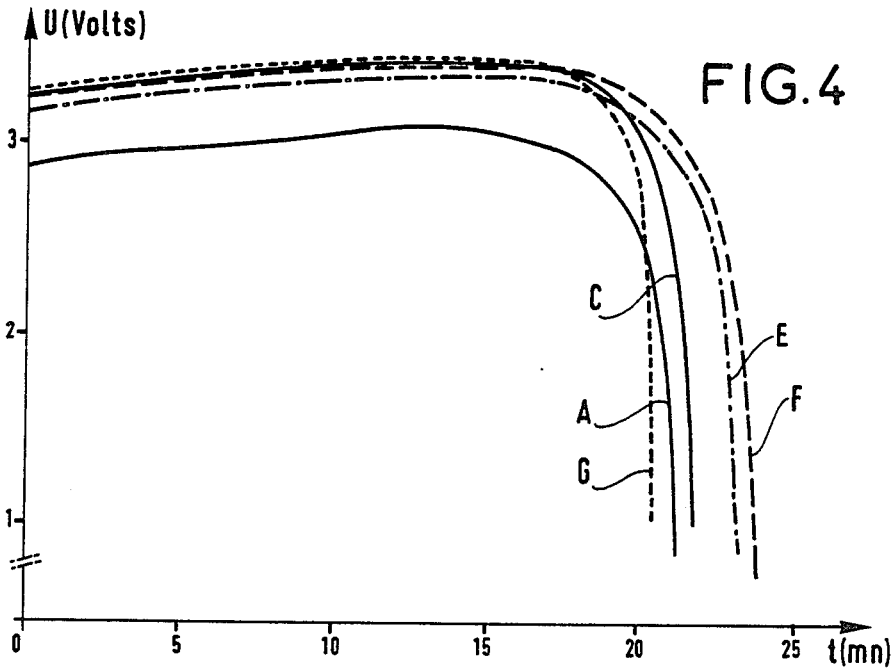
Figure 1:
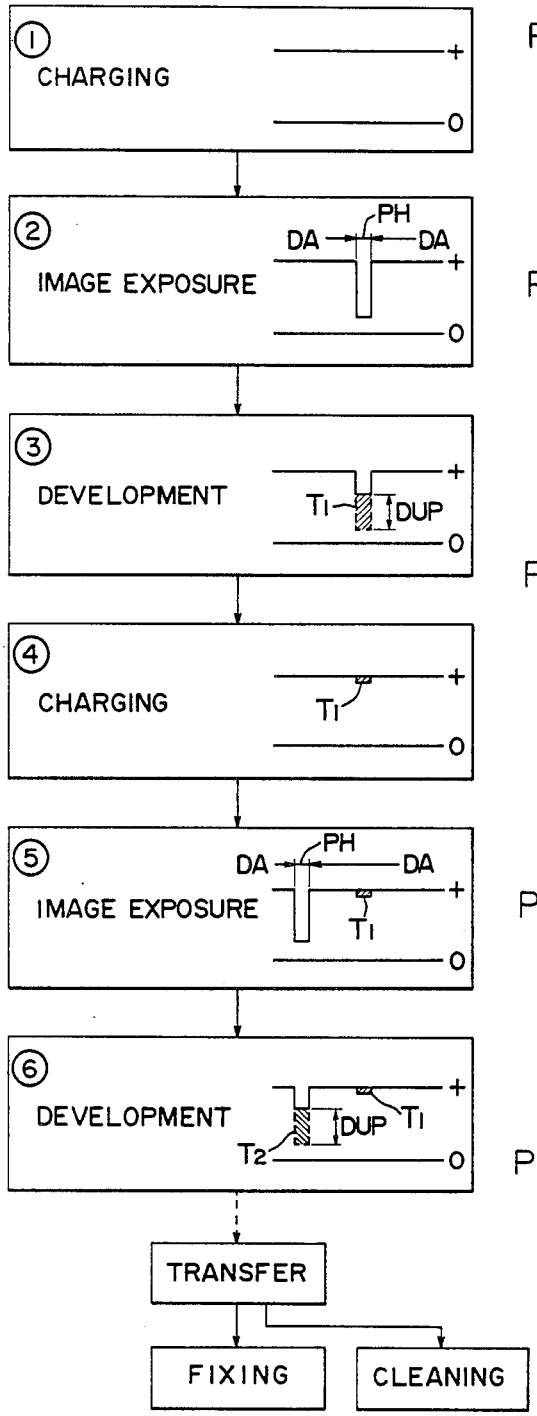
Figure 2A:
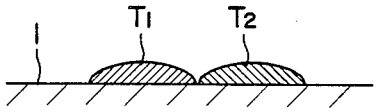
FIG. 2(A) PRIOR ART
FIGS. 2(A), 2(B) and 2(C) are sectional views showing the toner-applied states for forming the image, respectively.
Figure 2B:
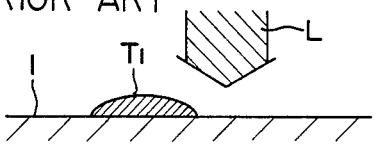
FIG. 2(B) PRIOR ART
Figure 2C:
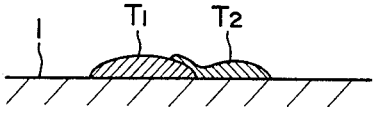
FIG. 2(C) PRIOR ART
Figure 3:
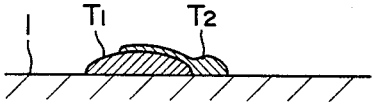
FIG. 3 PRIOR ART
Figure 4:
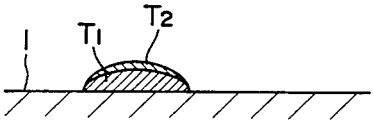
FIG. 4 PRIOR ART
Figure 5:
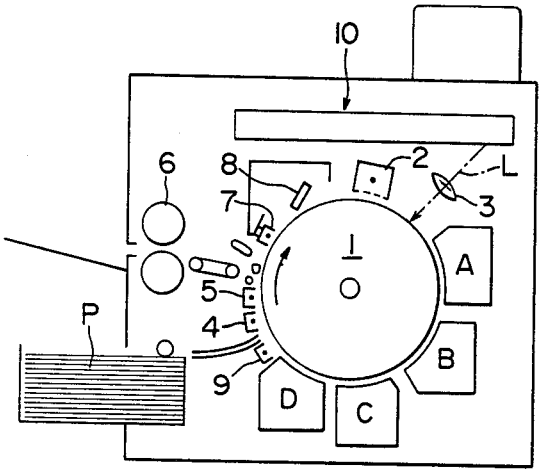

FIG. 5 is a schematic view showing an essential portion of a color image forming apparatus to which the present invention is applied.

A photosensitive member 1 is charged uniformly by means of a Scolotron charging device 2. In an image information processing unit indicated at 10, moreover, the output signal of an image pickup element having scanned a document, a signal transmitted from another device, or the data of a memory device are used as image data, and the photosensitive member 1 is exposed to a He-Ne laser beam L, which is modulated by those image data (e.g., by an acoustic-optical modulator), through a focusing lens 3 to form an electrostatic latent image. This electrostatic latent image is developed by means of a first developing device A to form a first toner image on the photosensitive drum 1. Then, this toner image is not transferred to recording paper but is charged again by the Scorotron charging device 2 and is exposed so that a second toner image is then formed by means of a second developing device B.

Likewise, moreover, third and fourth toner images are formed by means of developing devices C and D. In other words, the charging (although not necessary from the second and later ones)—exposing—developing steps are repeated four times while eliminating the transferring steps. After all the toner images are formed on the photosensitive drum 1, moreover, a precharge is conducted by means of a pretransfer charging device 9. As a result, the toners on the photosensitive drum 1 are newly charged in a uniform manner to transfer the resultant toner image is transferred by a transfer device 4 to the recording paper P being fed from a paper feeder. The recording paper is separated from the photosensitive member by a separating device 5 and is heated and fixed by means of a fixing device 6 constructed of rollers, at least one of which is heated, until it is discharged to the outside of the apparatus.

In this meanwhile, the photosensitive drum 1 having been subjected to the transfer is statically eliminated by means of a charge eliminating device 7, which has not been used during the toner image formation, and is then cleared off the toners left on its surface by means of a cleaning device 8 which has been left inoperative during the toner image formation.

Figure 6:
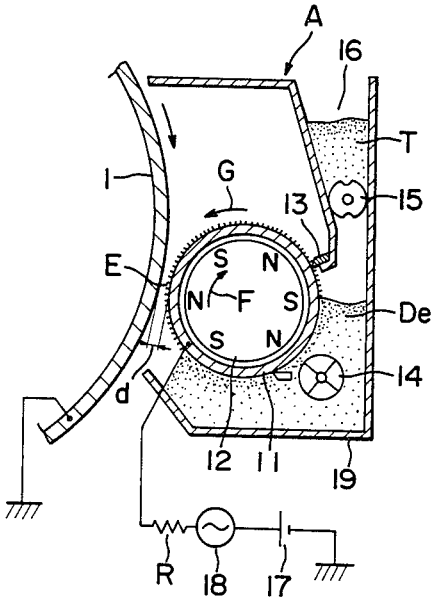

The constructions of the aforementioned respective developing devices will be described as to the developing device A, for example, as shown in FIG. 6. The remaining developing devices B, C and D have the identical basic constructions. A developer De is carried in the direction of arrow G by the turns of a magnetic roll 12 in the direction of arrow F and a sleeve 11 in the direction of the arrow G. The developer De has its thickness regulated by means of an ear regulating blade 13 while it is being carried midway. In a developer reservoir 19, there is disposed a stirring screw 14 for sufficiently stirring the developer De. When the developer De in its reservoir 19 is consumed to the last, a toner T is supplied from a toner hopper 16 by the turns of a toner supply roller 15. Moreover, there are connected in series a d.c. power supply 17 for applying a developing bias to the sleeve 11, an a.c. power supply 18 and a protecting resistor R. Still moreover, the sleeve 11 and the drum 1 are arranged in an opposed positions at a spacing d so that the toner is held out of contact with the drum 1 in a developing region E.

Figure 7:
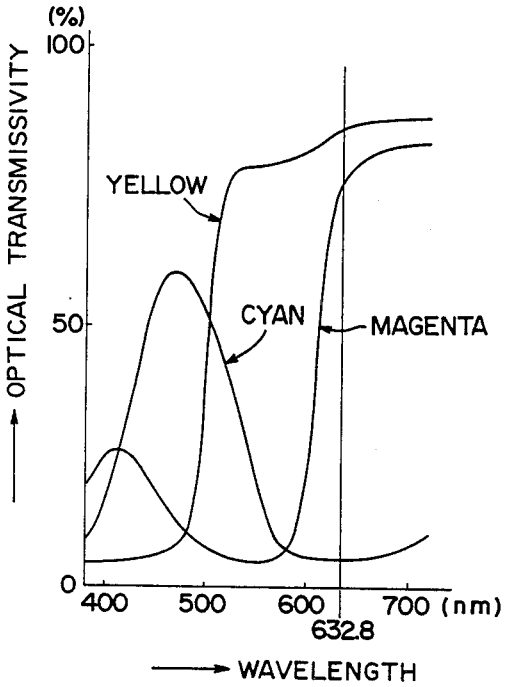

We have noted that the respective toners have different optical transmissivities in accordance with their kinds to the image exposing irradiating ray L (i.e., the He-Ne laser beam in this embodiment) when the color image is to be formed by means of the apparatus described above. Specifically, FIG. 7 shows the spectral transmissivities of the yellow, magenta and cyan toners, respectively. The He-Ne laser has an oscillating wavelength of 632.8 nm. Therefore, the toners are liable to transmit the laser beam in the order of yellow, magenta and cyan. In other words, even the photosensitive member bearing the yellow toner can be formed relatively freely with the magenta or cyan latent image by the image exposure.

By this reasoning, the development in the order of the yellow, magenta and cyan toners facilitates superposition of the toners to invite an advantage in case the color expression is to be performed by the foregoing method (2). Moreover, the black toner is desired to be developed finally because it is liable to absorb all the range of visible light. Even in the system (1), the color expression can be conducted relatively freely without requiring strict registration. These will be described in detail in the following.

Figure 8A:
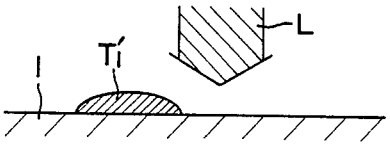
FIGS. 8(A), 8(B) and 8(C) are sectional views showing the toner-applied states for forming an image.
Figure 8B:
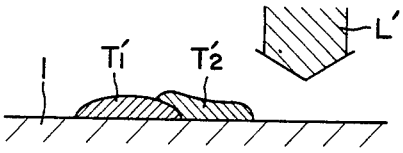
Figure 8C:
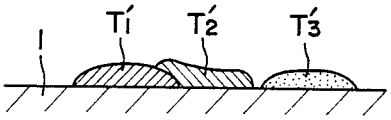

FIG. 8 shows a process for developing the toners of the respective colors in accordance with the aforementioned method (1). As shown in FIG. 8(A), the first development is first conducted with a yellow toner $T_1'$ by means of the aforementioned developing device A, for example. Next, after a second exposure L, as shown in FIG. 8(B), a second development is conducted with a magenta toner $T_2'$ by means of the aforementioned developing device B, for example. Likewise, moreover, after a third exposure L', a third development is conducted with a cyan toner $T_3'$ by means of the aforementioned developing device C, for example, as shown in FIG. 8(C).

In this process of FIG. 8, the position of the exposure L of FIG. 8(A) may be incomplete to invite a partially superposed exposure on the preceding toner $T_1'$. Since this preceding toner $T_1'$ is the yellow toner having a high optical transmissivity, as shown in FIG. 7, however, it highly transmits the exposing ray L so that an electrostatic latent image necessary for the development by the magenta toner is formed sufficiently. As a result, the next magenta toner $T_2'$ is applied in a sufficient amount even if it is superposed partially on the yellow toner $T_1'$. Thus, the desired color image of the combination of the toners $T_1'$, $T_2'$ and $T_3'$ can be formed highly densely in a high contrast and with an excellent reproductivity, and the desired color expression can be made at all times even if the registrations of the respective exposures are not so strictly (or with the aforementioned positional shift).

Figure 9A:
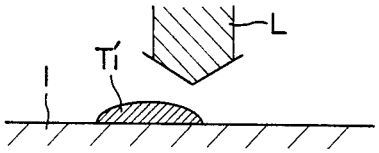
FIGS. 9(A), 9(B) and 9(C) are sectional views showing the toner-applied states for forming another image.
Figure 9B:
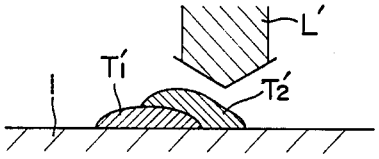
Figure 9C:
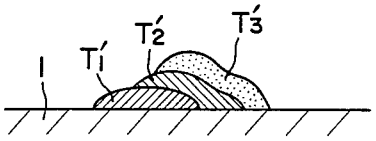

FIG. 9 shows an image forming process according to the aforementioned method 2. As shown in FIG. 9(A), more specifically, the yellow toner $T_1'$ is first applied at the first development, and the magenta toner $T_2'$ is then applied to the preceding toner $T_1'$ at the second development, as shown in FIG. 9(B), after the exposure L. Likewise, moreover, the electrostatic latent image for the cyan is formed by the third exposure L', and the cyan toner $T_3'$ is applied by the development, as shown in FIG. 9(C).

In these superposed developments, the preceding toner $T_1'$ is superior in optical transmissivity at the second and third exposures so that the amount of the toner $T_2'$ applied becomes sufficient, and the second toner $T_2'$ is also excellent in the optical transmissivity so that the amount of the toner $T_3'$ applied becomes sufficient. This makes it possible at all times to effect the desired color expression.

Moreover, the relationship between the aforementioned transmissivity of the toner to the irradiating ray and the developing order is applied to the case in which the respective latent images are formed by the irradiating rays having different wavelengths. In other words, the toner to be developed previously is so selected that its transmissivity to the ray to be emitted subsequently may be higher than that of the combination of another toner and the illuminating ray.

The developer to be used for such image forming method is exemplified by a two-component developer composed of a toner and a carrier and a one-component developer composed of a toner only. The two-component developer is required to have administration of the amount of the toner to the carrier but has an advantage that the frictional charge control of the toner particles can be easily conducted. Since especially the two-component developer composed of a magnetic carrier and a nonmagnetic toner need not contain a large amount of black magnetic material in the toner particles, moreover, a color toner freed from somberness due to the magnetic material can be used so that a clear color image can be formed.

In this two-component developer, the toner is usually composed of the following components (1) to (6):

(1) 80 to 90 wt. % of thermoplastic resin (or binder):

Examples: polystyrene; styrene-acryl copolymer; polyester; polyvinyl butyral; epoxy resin; polyamide resin; polyethylene; ethylene-vinyl acetate copolymer; or their mixtures.

(2) 15 wt. % or less of pigment (or coloring agent):

Examples:

Black: carbon black;

Blue: copper phthalocyanine; sulfonamide; dielectric dye;

Yellow: benzidine derivatives;

magenta: polytungstolynate; rhodamine B lake, Carmine 6B; and so on.

(3) 5 wt. % or less of charge controlling agent:

Anodic toner: mostly of electron donating dye of the Nigrosine group, the remainder being metal salts of naphthenate or higher fatty acid, alcoxycyl amine, alkyl amide, chelate, pigment, fluorinated surface-active agent or fourth-grade ammonium.

Cathodic toner: electron accepting organic complex being effective, the remainder being chlorinated paraffin, chlorinated polyester, polyester having excess acid radicals, or sulfonylamine of copper phthalocyanine.

(4) Fluidizer:

Examples: represented by colloidal silica and hydrophobic silica, the remainder being silicon varnish, metallic soap, or nonionic surface-active agents.

(5) Cleaning Agent:

Prevents the toners in the photosensitive member from filming.

Examples: metallic salts of fatty acid, oxidized silisic acid having organic radicals on its surface, or surface-active agents of fluorine group.

(6) Filler:

Aims at improving the surface luster of an image and reducing the raw material cost.

Examples: calcium carbonate, clay, talc, or pigment.

Other than these materials, a magnetic material may be introduced to prevent fog and toner dispersion.

As a magnetic powder, there have been proposed tri-iron tetroxide of 0.1 to 1 micron, γ-ferric oxide, chromium dioxide, nickel ferrite, iron alloy powder and so on. At present, tri-iron tetroxide is used most frequently and is contained in 5 to 70 wt. % in the toner. Although the resistance of the toner varies considerably in dependence upon the kind and amount of the magnetic powder, the amount of the magnetic material is preferred to be 55% or less by weight so as to ensure a sufficient resistance. In order for the color toner to maintain a clear color, moreover, the amount of the magnetic material is desired to be 30% or less by weight %.

In addition, as the resin suitable for the pressure fixing toner, an adhesive resin such as wax, polyolefines, ethylene-vinyl copolymer, polyurethane or rubber is selected so that it may be plastically deformed and adhered to the paper by a force of about 20 Kg/cm. A capsule toner may be used.

By using the above-specified materials, the toner can be prepared according to the method known in the prior art.

In order to form a more preferable image, according to the present invention, the toner particles are usually desired to have an average diameter of 50 microns or less determined by the relationship with the resolution. In the present invention, the toner particle diameter is not limited on principle but is usually preferred to be about 1 to 30 microns determined by the relationship with the resolution, the toner dispersion and the carriage.

In order to visualize fine points or lines or to improve the gradation, on the other hand, the magnetic carrier particles are the particles which are composed of magnetic particles and a resin (e.g., a resin-dispersed system of magnetic powder and a resin or resin-coated magnetic particles) and are preferred to have an average diameter of 50 microns or less, or more preferred to have a diameter less than 30 microns and more than 5 microns.

Moreover, in order to prevent a problem that charges become liable to be injected by the bias voltage into the carrier particles obstructing the formation of an excellent image so that the image retainer surface becomes liable to trap the carriers and so that the bias voltage is not applied sufficiently, the carrier is preferred to have a resistivity of $10^8$ ohms-cm or more, preferably, $10^{12}$ ohms-cm or more, more preferably, $10^{14}$ ohms-cm or more. Moreover, the carrier particles are recommended to have that resistivity and the aforementioned diameter.

The carrier thus granulated is prepared by using the above-specified magnetic material and thermoplastic resin to be used as the toner thereby to coat the surface of the magnetic material with the resin, or by forming the particles of a resin containing fine particles of a magnetic material dispersed and by selecting the particles obtained in accordance with the diameter by average particle diameter selecting means known in the art. In order to improve the stirring of the toner and the carrier and the carriage of the developer and to improve the charge controllability of the toner to make it less likely to cause cohesion between the toner particles and between the toner particles and the carrier particles, it is desired to round the carriers. In order to produce round magnetic carrier particles, there is adopted a method for resin-coated carrier particles by which magnetic particles rounded as much as possible are selected and subjected to a resin coating treatment. For a carrier having fine particles of the magnetic material dispersed throughout, there is adopted either a method by which fine particles of a magnetic material are used, if possible, and are subjected a rounding treatment by hot water of a hot air blower after the resin-dispersed particles are formed; or a method by which round resin-dispersed particles are formed directly by spray drying.

In the image forming method of the present invention, there can be adopted either a developing system which uses a one-component developer, as is disclosed in U.S. Pat. No. 3,893,419, Japanese Patent Laid-Open Nos. 55-18656 to 18659 and Japanese Patent Laid-Open No. 56-125753, or a developing system which uses the two-component developer, as is disclosed in Japanese Patent Application Nos. 58-57446, 58-97973, 59-4563, 59-10699, 58-238295, 58-238296 and 59-10700.

Especially according to the developing system using two-component developer, as is disclosed in Japanese Patent Application No. 58-238296, it is desirable that the following inequalities be satisfied, if the a.c. component of the developing bias has an amplitude $V_{AC}$(V) and a frequency f (Hz) and if the gap between the image carrier and the developer carrier for carrying the developer is designated at d (mm):

$$0.2 \leqq V_{AC}/(d \cdot f); \text{ and}$$

$$\{(V_{AC}/d) - 1500\}/f \leqq 1.0.$$

Thus, by selecting the developing conditions such as the voltage and frequency of the a.c. bias, an image of high quality can be obtained without any disturbance of the image or color mixing. The reasons for this will be explained in the following on the basis of the results of the experiments conducted by us.

The experimental conditions set are, as follows. As the developer, there was used a two-component developer which was composed of a magnetic carrier and a nonmagnetic toner. The carrier was a spherical one which was prepared by dispersing fine ferrite particles into a resin having an average diameter of 30 microns [this diameter was the weight-averaged particle diameter measured by an Omniconi Alpha (Baush & Lomb Inc.) or a Coulter counter (Coulter Electronics, Inc.) ], a magneticism of 50 emu/g and a resistivity of $10^{14}$ ohms-cm or more. The resistivity was a value which was obtained by tapping the particles in a container having a sectional area of 0.50 $cm^2$, by applying a load of 1 $Kg/cm^2$ to the tapped particles so that the carrier particles had a thickness of about 1 mm, and by reading a current value when a voltage for establishing an electric field of 1,000 V/cm between the load and the bottom electrode. The toner used was prepared by a small amount of a charge controller to 90 wt. % of a thermoplastic resin and 10 wt. % of a pigment, and by blending and pulverizing them to have an average particle diameter of 10 microns.

The developer was prepared by mixing 80% by weight of said carrier and 20% by weight of said toner. The toner was charged positively as a result of the friction with the carrier. Moreover: the photosensitive drum was formed in advance with a toner image; the gap d between the photosensitive drum and the sleeve was 1.0 mm; the developer layer had a thickness of 0.5 mm; the charge potential of the photosensitive member was set at 600 V; the d.c. component of the developing bias was set at 500 V; and the frequency of the a.c. component was set at 1 KHz.

Under the conditions specified above, the relationship between the amplitude of the a.c. component and the density of the toner image formed by the reversal phenomenon on the exposed part (at a potential of 0 V) of the photosensitive drum was measured. The results have clarified the phenomena, as will be described in the following. According to the observations, the effect of the a.c. component of the electric field appeared for the amplitude of the a.c. component of 200 V/mm or larger in any case in which the toner used was charge-controlled to have average charges of 30 μc/g, 20 μc/g and 15 μc/g. For an amplitude of the a.c. component of 2,500 V/mm or larger, however, the toner image formed in advance on the photosensitive drum was partially broken. Moreover, the measurements of the changes in the image density under the same conditions as those of the aforementioned experiments when the frequency of the a.c. component of the developing bias was set at 2.5 KHz and when the intensity $E_{AC}$ of the a.c. electric field was varied have revealed that the image density was enlarged when the amplitude $E_{AC}$ of the a.c. field intensity exceeded 500 V/mm, and that the toner image formed in advance on the photosensitive drum was partially broken when the amplitude $E_{AC}$ exceeded 4 KV/mm.

As is understood from those results, image density varies largely across a certain amplitude. This value of the amplitude is almost independent of the average charge of the toner. The reasons for this are thought to be, as follows. In the two-component developer, more specifically, it can be predicted that the toner will be charged as a result of the friction with the carrier or its mutual friction so that its charge is distributed over a wide range, and it is through most toner developed will be that toner having a high charge. As is also thought, even if the average charge is controlled by the charge controller, the ratio occupied by the toner having a high charge does not vary so widely, consequently, the changes in the developing characteristics are observed but they are not prominent.

Figure 10:
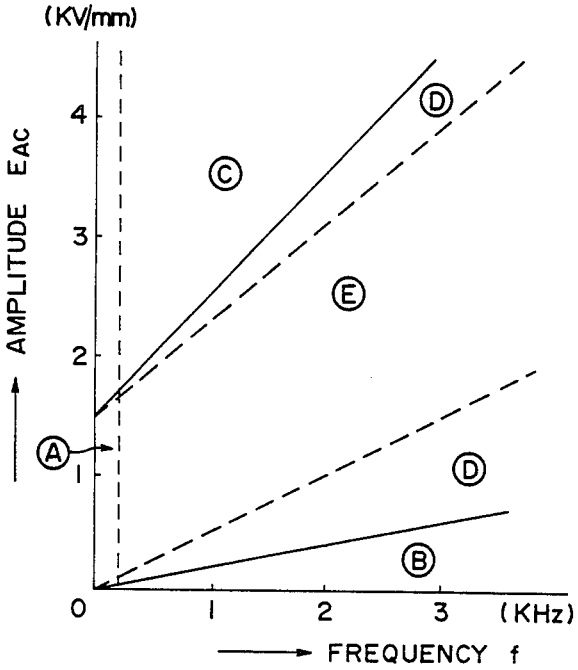

Now, experiments similar to the aforementioned ones are conducted under changing conditions so that the relationship between the amplitude $E_{AC}$ of the intensity and the frequency of the a.c. field can be determined, as shown in FIG. 10. In FIG. 10: the region (A) is one in which development irregularities are liable to occur; the region (B) is one which no effect of the a.c. component appears; the region (C) is one in which the return of the toner is liable to occur; and the regions (D) and (E) are ones in which the effect of the a.c. component appears but no return of the toner occurs so that the region (E) is the especially preferable one.

These results indicate that a proper region for the amplitude of the intensity and the frequency of the a.c. electric field is present so that the toner image of the succeeding (or later) stage may be developed in a proper density without breaking the toner image formed in the preceding stage on the photosensitive drum, as will be reasoned in the following.

As to the region in which the image density has a tendency to increase for the amplitude $E_{AC}$ of the a.c. field intensity, the a.c. component of the developing bias acts to make the threshold value, at which the toner flys from the sleeve, liable to be exceeded so that even a toner with a small charge is applied to the photosensitive drum for developing. As a result, the image density increases with the increase in the a.c. electric field.

In the region in which the image density is saturated for the amplitude $E_{AC}$ of the a.c. field intensity, on the other hand, that phenomenon can be explained in the following for the region in which the amplitude $E_{AC}$ of the a.c. field intensity is at 1.2 KV/mm or larger. In this region, more specifically, as the amplitude of the a.c. field intensity is enlarged, the toner subjected to intense vibration, and the cluster formed of the cohesion of the toner is likely to be broken so that only the toner having a high charge is applied selectively to the photosensitive drum whereas the toner particles having a low charge are resistant to development. Moreover, the toner having a low charge is liable to be returned to the sleeve by the a.c. bias because it has a weak mirror imaging force even after it has been applied to the photosensitive drum. Moreover, because the charges are caused to leak from the surface of the photosensitive drum due to excessively high the field intensity of the a.c. component, the toner is likely to resist development. As a matter of fact, it is through that those factors overlap to leave the image density constant for the increase in the a.c. component.

It has also been found that, for the increased a.c. field intensity to have an amplitude of 2.5 KV/mm or more under the aforementioned conditions, as has been described hereinbefore, the toner image formed in advance on the photosensitive drum is broken to an extent which increases as the a.c. component increases. This is thought to be caused by the fact that the force to return the toner applied to the photosensitive drum to the sleeve is exerted upon the toner by the a.c. component.

When the toner images ar to be sequentially developed on the photosensitive drum, and the toner image formed in advance is broken at the succeeding developing step, image reproduction fails.

As is apparent from the comparison of the aforementioned results, moreover, the experiments with the changing frequency of the a.c. component have revealed that the image density is reduced at higher frequencies. This is caused by the fact that the toner particles fail to follow the changes in the electric field which has its vibrating range narrowed so that they are less likely to be applied to the photosensitive drum.

The experimental results described above have led to the conclusion that the succeeding development can be conducted at the proper density without disturbing the toner image formed already on the photosensitive drum, if the development is conducted under conditions satisfying the following inequalities if the a.c. component of the developing bias has the amplitude $V_{AC}$(V) and the frequency f(Hz) and if the gap between the photosensitive drum and the sleeve is set at d(mm) at each developing step:

$$0.2 \leqq V_{AC}/(d \cdot f); \text{ and}$$

$$\{(V_{AC}/d) - 1500\}/f \leqq 1.0.$$

Of these conditions, the following inequalities are desired to be satisfied so that a sufficient image density may be obtained and so that the toner images formed at and before the preceding step may not be disturbed:

$$0.5 \leqq V_{AC}/(d \cdot f)$$

$$\{(V_{AC}/d) - 1500\}/f \leqq 1.0.$$

If, of these, especially the following inequalities are satisfied, $$0.5 \leqq V_{AC}/(d \cdot f); \text{ and}$$

$$\{(V_{AC}/d) - 1500\}/f \leqq 0.8.$$

It is possible to form a clearer multi-color image having no somberness and to prevent the toners of different colors from being mixed into the developing device even after a number of operations.

In order to prevent the developing irregularities due to the a.c. component, moreover, the frequency of the a.c. component is more desirable to be set at 200 Hz or more. If a rotating magnetic roll is used as the means for supplying the developer to the photosensitive drum, the frequency of the a.c. component is ideally set at 500 Hz or more so as to eliminate the influences from the a.c. component and the beats caused as a result of the turns of the magnetic roll.

Since, in the foregoing experimental examples, the developer is carried out of contact with the image retainer (i.e., the photosensitive drum), the toner is transferred to the latent image surface by the a.c. bias. The electric force directed from the developing device to the image retainer and the electric force in the opposite direction are applied to the toner particles between the image retainer and the developing device due to the phase of the alternating current. Of those electric forces, the latter causes the toners on the image retainer to move to the developing device so that a different color toner is mixed into the developing device. In order to prevent this phenomenon and to develop the subsequent toner images sequentially on the photosensitive drum at a constant density without breaking the toner images formed on the photosensitive drum, it is preferable to adopt any one or any combination of the following methods as the developments are repeated:

(a) The toners having higher charges are sequentially used;

(b) The a.c. component of the developing bias is sequentially reduced; and (c) The frequency of the a.c. component of the developing bias is sequentially increased.

In other words, the toner particles having the higher charges are the more liable to be influenced by the electric field. As a result, if the toner particles having a high charge are applied at the initial development to the photosensitive durm, they may be returned to the sleeve at the development of the succeeding step. Therefore, the aforementioned method (a) is intended to prevent the aforementioned toner particles from returning to the sleeve at the succeeding step by using the toner particles having low charges for the initial development. The method (b) is intended to prevent the toner particles sticking already to the photosensitive drum from returning by sequentially dropping the more the field intensity as the developments are repeated the more (i.e., at a later step). A specific method for dropping the field intensity is exemplified by the method of sequentially dropping the voltage of the a.c. component or by the method of making the gap d between the photosensitive drum and the sleeve wider for later development. The aforementioned method (c) is intended to prevent the toner particles already sticking to the photosensitive drum from returning by enlarging the frequency of the a.c. component sequentially in accordance with the repetitions of the developments. These methods (a), (b) and (c) are effective even if they are used separately, but are more effective if they are used in combination such that the toner charges are sequentially enlarged with the repetitions of the developments and such that the a.c. bias is sequentially dropped. In case the foregoing three systems are adopted, moreover, the proper image density or color balance can be held by adjusting the respective d.c. biases.

In addition to the foregoing methods (a) to (c), the following methods (d) to (h) can also be adopted:

(d) The developing device left unused is positioned apart from the image retainer;

(e) The toner supplying rates are sequentially increased;

(f) The potential contacts of the latent images are sequentially increased;

(g) The gaps between the image retainer and the developer layers are sequentially enlarged; and (h) Such a bias is applied to the developers left unused as to prevent the toners from being mixed thereinto.

Next, the present invention will be described more specifically in the following.

EXAMPLE 1

The color image was recorded on the basis of the methods described hereinbefore. The conditions are specified in the following:

Drum: Se photosensitive member;
Drum diameter: 120 mm;
Drum linear velocity: 120 mm/sec;
Light source: He-Ne Laser;
Charge: +600 V (by Scolotron, recharge);
Sleeve diameter: 30 mm;
Sleeve revolution: linear velocity of 120 mm/sec;
Number of magnet poles: 6
Revolutions of magnet: 1,000 r.p.m.;
Density of magnetic flux on sleeve surface: 900 G (Maximum);
Developer (shared among developers): two-component developers;
Toner:
particle diameter: 10 microns on average;
resistivity: $10^{14}$ ohms-cm or higher;
Carrier:
particle diameter: 30 microns on average;
magneticism: 50 e.m.u./g;
resistivity: $10^{14}$ ohms-cm or higher;
Toner charge (shared among developers): 20 μc/g;
Thickness of developer layer: 0.5 mm;
Drum-sleeve gap (shared among developers): 0.8 mm;
Developing bias (shared among developers):
AC 1.5 KV (effective value); 2 KHz; and
DC 500 V.

Figure 11:
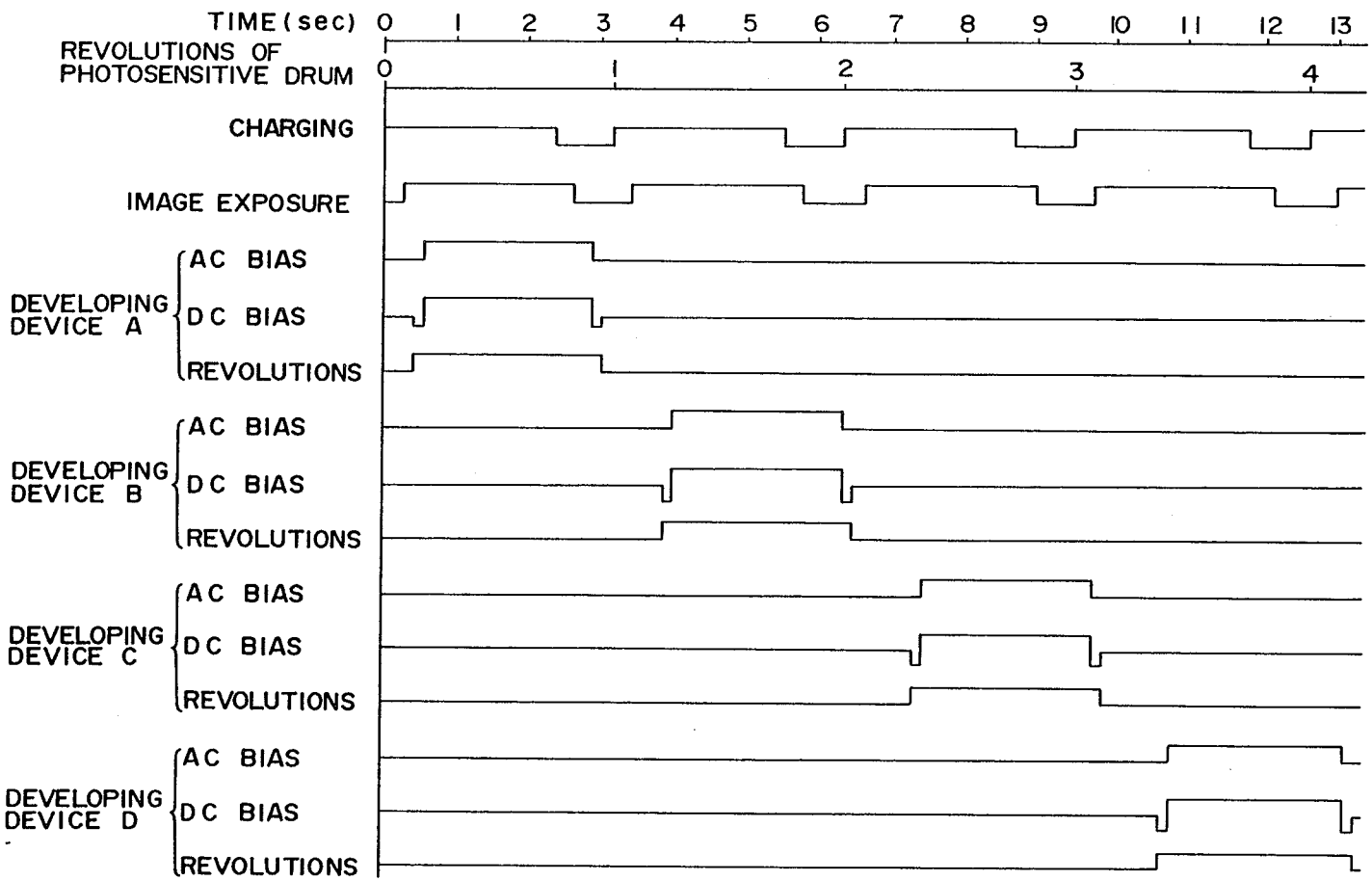

Incidentally, the yellow, magenta, cyan and black toners were reserved in the developers A, B, C and D, respectively. The image formation was effected by the aforementioned system (1) (i.e., the system not having the toners superposed). The developments were conducted in the order of A→B→C→D. The developing bias was applied only to the developing device conducting the development, and the developing sleeve and the magnetic roll were driven only for the development. FIG. 11 is a time chart showing this process.

It was confirmed that a variety of colors could be expressed with ease under the above-specified conditions.

EXAMPLE 2

This Example is different in the following items from the Example 1:

(i) The charging step was conducted only before the first image exposure, but no recharge was performed. The charge potential was at +700 V. Because of the dark decay of the photosensitive member, the potentials of the part other than the image part were at +650 V, 600 V and 550 V at the respective developing steps.

(ii) The developing biases were enumerated by the following Table:

(iii) The latent image formation resorted to the aforementioned system (2) (i.e., the system in which the toners were superposed).

| Developing Device | A | B | C | D |
|---|---|---|---|---|
| AC | | | | |
| Effective Value | 1 KV | 1.8 V | 1.8 V | 1.5 V |
| Frequency | 1.5 KHz | 2 KHz | 2 KHz | 2 KHz |
| DC | 600 V | 550 V | 500 V | 450 V |

In the foregoing Examples, a He-Ne laser beam was used as the light source, but the present invention should not be limited thereto but can use any light source. If the light source having a peak wavelength of 500 nm is used, for example, the developments may be conducted in the order of cyan→yellow→magenta. The developer used should not be limited to the two-component developer. Moreover, the present invention can also be applied to the apparatus which is equipped with a plurality of image exposing devices. Still moreover, any color can be reproduced by driving the plural developing devices relative to one kind of latent image.

Incidentally, the normal development for developing the non-exposed part may be conducted in place of the reversal development which was adopted in the aforementioned respective Examples. As to the transferring and fixing method, on the other hand, there can be used the well-known method such as a method in which EF paper is used, the adhesive transfer method or the pressure fixing method.

Moreover, the present invention can be applied not only to the recording system for electrophotography but also to the non-impact printer making use of the electrostatic recording system or the magnetic recording system.

As has been described hereinbefore, according to the present invention, since the development is conducted by previously using the toner which has a sufficiently high transmissivity to the irradiating ray for the second image exposure, the subsequent irradiating ray can transmit sufficiently through the preceding toner to make it possible to form the latent image to which the subsequent toner can be applied in a sufficient amount. This makes it possible to easily form an image which has an excellent color balance but no disturbance.

As to the exposing ray to be used in the method of the present invention, the invention is not limited to the one for the first exposure, in which no toner is present on the photosensitive member. For the second and later exposures, however, the ray may have a spectral distribution peak in the wavelength range in which all the respective toners composing the toner images already formed on the photosensitive member exhibit a reflectivity of 40% or more. The light source is not especially limited but may preferably be exemplified by a color ray which is generated by using laser monochromatic light, or a white light source such as a halogen lamp together with many kinds of filters. As to the method of the color-separated exposure, on the other hand, there can be used a variety of systems such as the directly separated exposure of the trichromatic separation, in which the document is illuminated with color rays, for example, the blue, green and red color rays in the full-color copy, or the method in which the image is modulated in electric signals and is input in different colors for recording.

The former method is usually used in the so-called color copying machine or the like, whereas the latter is the method to be used in color printers or the like. In the latter case, the colors of the exposing ray can be selected independently of the color of the image to be recorded and is preferably exemplified by the OFT (i.e., Optical Fiber Tube), the laser, the LED, the light source using a liquid crystal shutter or the like.

As to the case in which the full color image is to be formed by using color separation method or a monochromatic ray, the relationship between the exposing ray and the spectral reflectivities of the toners according to the method of the present invention will be explained in the following.

Figure 13:
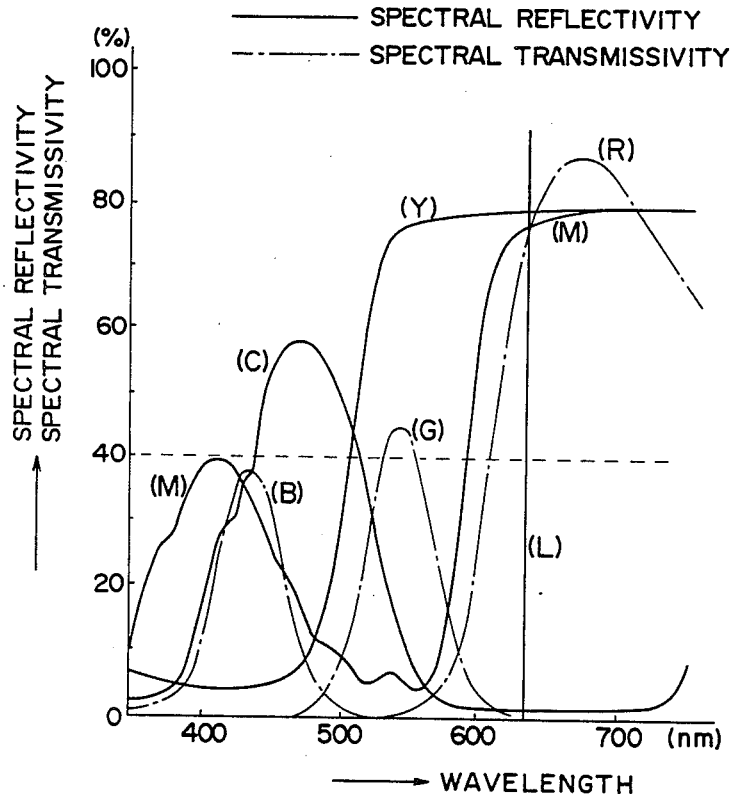
FIG. 13 is a graph showing the spectral reflectivities of yellow, magenta and cyan toners used in another embodiment of the present invention, the spectral transmissivities of blue and green color filters, and the spectral distribution of a laser beam.

FIG. 13 plots the spectral reflectivities of the yellow (Y), magenta (M) and cyan (C) color toners for the full color used in later-described experimental examples and indicates that the yellow and magenta toners hardly absorb rays having wavelengths of 520 nm and 600 nm or longer whereas the cyan toner mostly absorbs rays of a wavelength longer than 550 nm. Moreover, these spectral reflectivities are common for the full-color toner.

The combination of the exposing optical color and the toner colors in the trichromatic separation for forming a full-color image is composed of blue: yellow, green: magenta, and red: cyan, as is well known in the art. The order of forming this image has to be freed from the fact that the image formed previously does not absorb the subsequent exposing ray and is most preferably of the yellow, magenta and cyan in this case.

Figure 12:
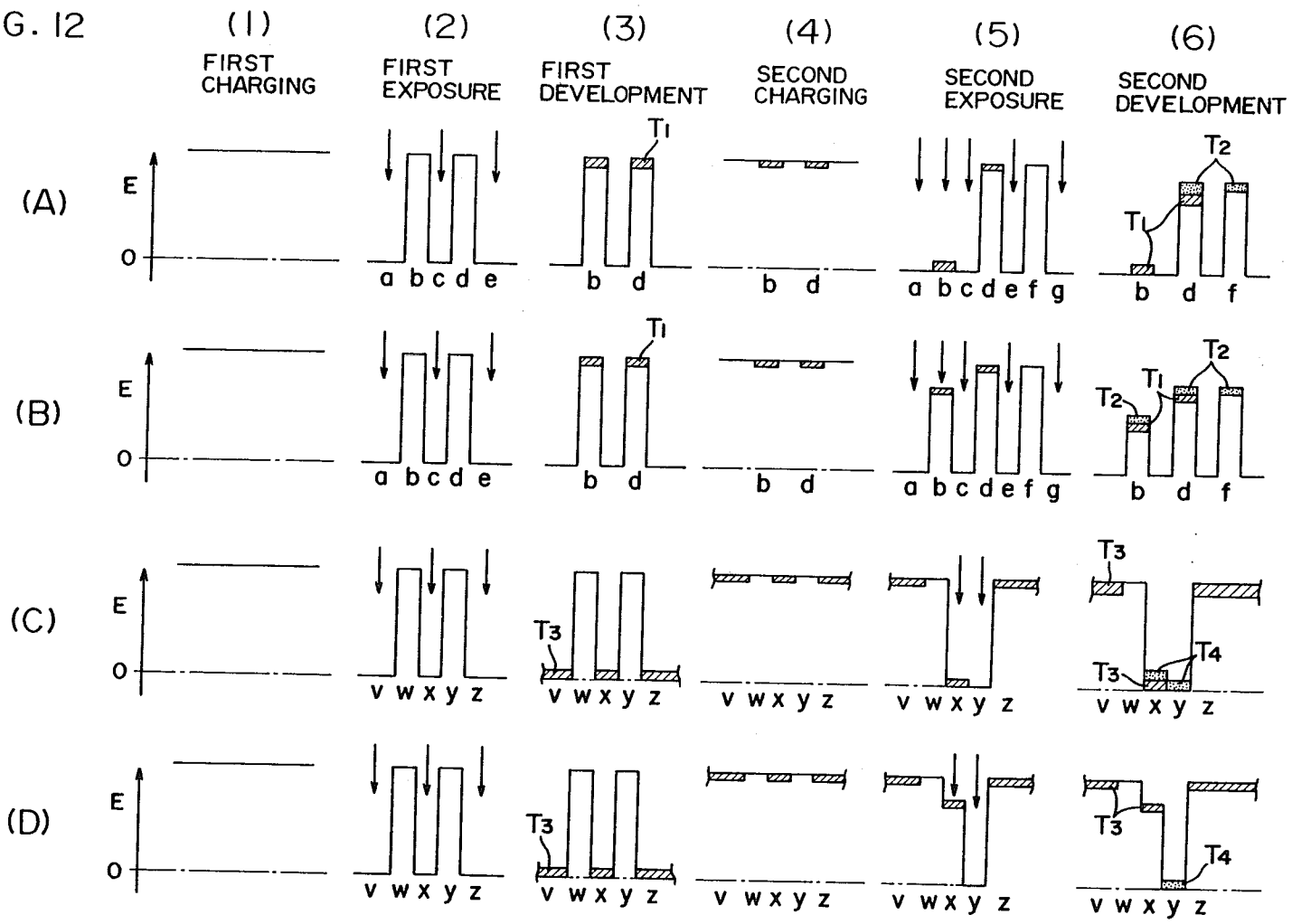
FIG. 12 is a schematic view showing the states of toner images formed in a superposed manner.

First of all, the blue exposure is conducted to form a yellow image. Since, in this case, no toner image is formed on the photosensitive member, there is neither a problem due to the optical absorption nor a limitation to the spectral distribution of the exposing ray. Indicated at (B) in FIG. 13 is a curve which expresses generally the spectral transmissivity of the blue filter for the trichromatic separation. Next, the exposure is conducted with the green color which has to have its peak wavelength located in the region having a reflectivity of 40% or more to the yellow toner having formed the image in advance, i.e., in a longer range than 510 nm in the case of the toner of FIG. 13. Indicated at (G) in FIG. 13 is a curve which expresses one example of the spectral distribution of the green filter conforming to that condition. Next, the red color exposure is conducted, whereupon the yellow and magenta images are formed in a superposed manner upon the photosensitive member so that the peak of the spectral distribution of the red light has to be located in a range, in which the reflectivity to the magenta toner is 40% or more, i.e., in a longer wavelength than 590 nm in this case of FIG. 13. Moreover, this region also has a reflectivity of 40% or more to the yellow toner, and the condition of the method of the present invention is satisfied by using the red light in that wavelength range so that the correct cyan image can be formed in the superposed manner without being obstructed by the shield of the magenta and yellow toners. If the ray having its peak in the shorter wavelength range is used, the toner is applied neither to the unnecessary part (in the case of the normal development), as has been described with reference to FIG. 12, nor to the necessary part (in the case of the reversal development) so that the desired color image cannot be obtained.

A curve (R) of FIG. 13 exemplifies the spectral distribution of the red filter conforming to that condition. The longer wavelength side of the spectral transmissivity curve of the red filter usually extends generally in a horizontal direction to the outside of the visible range, but a near infrared ray cutting filter is used together so as to improve the color reproductivity.

The aforementioned outer blue, green and red filters to be used can be exemplified by the commercially available glass fitlers and may be combined with a white color light source such as a halogen lamp to provide the exposing light source. Moreover, light sources having blue, green and red wavelengths satisfying the above-specified conditions can be used in combination.

If the order of forming the trichromatic image is made different from the above one, the superposition of the images is adversely affected, as enumerated in Table 1, due to the optical absorption by the toner image formed previously:

TABLE 1

| 1st | 2nd | 3rd | Propriety of Superposition | | |
|---|---|---|---|---|---|
| B/Y | G/M | R/C | O | O | O |
| B/Y | R/C | G/M | O | O | X |
| G/M | B/Y | R/C | O | X | O |
| G/M | R/C | B/Y | O | O | X |
| R/C | G/M | B/Y | O | X | X |
| R/C | B/Y | G/M | O | Δ | X |

The Table tabulated the combinations of the filters/the toners, in which symbols O, Δ and X indicate the possibility, intermediate and impossibility of forming the subsequent images by the toners formed previously, respectively.

The description to be made in the following is directed to the case in which a single light source is used, as in the printer. Since, in this case, the differences in the colors are wholly processed as electric signals, the colors of the exposing rays are not limited in the least from this aspect, but the relationship with the absorptions of the toners have to be considered like the aforementioned trichromatic separation case, and the conditions of the present invention have to be satisfied.

In order to satisfy the conditions of the present inventions by using a single light source, it is sufficient to use a light source, which has its spectral distribution peak located in the range in which the reflectivity of the longer wavelength reflectivity range to the magenta toner is 40%, i.e., the light source which has its peak located in the wavelength range longer than 570 nm in the case of the toner of FIG. 13. In this case, too, the image forming order may be of the yellow, magenta and cyan or of the magenta, yellow and cyan in case a full-color image is to be formed.

In case the photosensitive member is to be scanned to form an image with light having a wavelength longer than 590 nm, e.g., a beam having a wavelength of 632.8 nm (as indicated at a curve (L) in FIG. 13) emitted from the He-Ne laser, the exposure of the magenta image is not obstructed because the absorption of the wavelength of 632.8 nm by the yellow toner is slight, even if the yellow image is first formed and if the magenta image is then exposed. Even after the yellow and magenta images are superposed, the absorption of the ray of the wavelength of 632.8 nm by the two toners is slight, and the subsequent formation of the cyan image is not obstructed so that the desired full-color image can be correctly formed.

If the ray having a wavelength in the vicinity of 500 nm, in which both the cyan and yellow toners have reflectivities of 40% or more, is used to form the toner images in the order of the yellow and cyan or the order of the cyan and yellow and if the magenta image is formed at last, a full-color image can be formed.

When a ray in the vicinity of 550 nm, for example, which fails to conform to the conditions of the present invention, is used, the yellow and magenta images can be formed without any problem. Since a 550 nm ray is highly absorbed by the magenta toner, however, the cyan toner is trapped during the cyan development by the magenta part, if the case of the normal development is taken up as an example, so that the desired full-color image cannot be formed.

The development for forming a multi-color image according to the method of the present invention can be performed for both the normal and reversal developments. The method of and the condition and apparatus for the development are not limited to a particular configuration. In order not to disturb the toner image which has already been formed before the development, however, it is preferable to adopt the so-called "non-contact development" in which the developer layer including the toner is not in direct contact with the surface of the photosensitive member.

Figure 14:
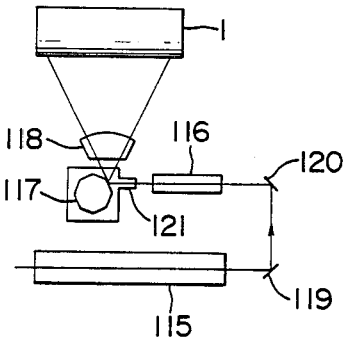
FIG. 14 is a schematic view showing a laser beam scanner.

The laser beam scanner shown in FIG. 14 is the image exposing device in the apparatus of the present invention. In place of the laser beam scanner, however, a document scanning optical system which uses the same lens as that used usually in the electronic copying machine can be used. In the case, are provided a plurality of color separation filters, for example, blue, green and red separation filters which are automatically inserted in an alternate manner into any of the optical paths. The spectral transmitting characteristics of those filters or the wavelength of the laser beam naturally have to satisfy the conditions of the present invention in relation to the spectral reflectivities of the toners used.

In the laser beam scanner of FIG. 14, the laser beam emanating from a laser 115 such as the He-Ne laser is turned on and off by means of an acoustic-optical modulator 116 and is deflected by means of a mirror scanner 117, which is composed of a rotating polygonal or octagonal mirror, to form image exposing lines of different colors for scanning the surface of the image forming member 1 at a constant speed through a focusing f-$\theta$ lens 118. Numerals 119 and 120 indicate mirrors, and numeral 121 indicates a lens device for varying the diameter of the beam to become incident upon the focusing f-$\theta$ lens 118 so as to vary the diameter of the beam on the image forming member 1.

Figure 15:
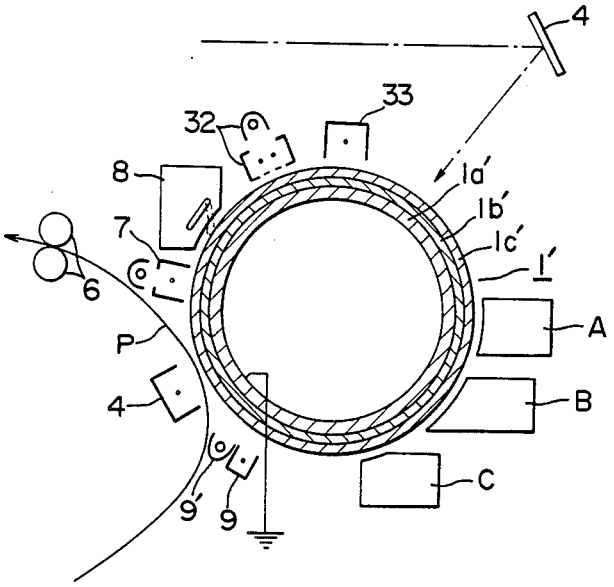
FIG. 15 is a schematic view showing a multi-color image forming apparatus.

FIG. 15 shows another example of the multi-color image forming apparatus which is different from the aforementioned apparatus.

The recording apparatus of FIG. 15 is different from that of FIG. 5 in the points: that a drum-shaped photosensitive member 1' is formed with a transparent insulating surface layer 1'c on the surface of a photosensitive member 1'b similar to that of FIG. 5; and that the charging device 2 of FIG. 5 is replaced by a primary charging device 32 constructed of the combination of an exposing lamp (which may be dispensed with in the case of the photosensitive member capable of having charges injected thereinto) and a corona discharge device, and a secondary charging device 33 constructed of a corona discharge device, but the remainder is similar to that of the recording apparatus of FIG. 5. The corona dischargers of the primary charging device 32 and the secondary charging device 33 may preferably be exemplified by the Scolotron corona discharge device, as shown.

As the exposing light source, there is used a document scanning optical system which is constructed of a halogen lamp, an interchangeable filter group, and a lens but which is omitted from FIG. 15. The exposing light source can be exemplified by a laser beam scanner.

Figure 16:
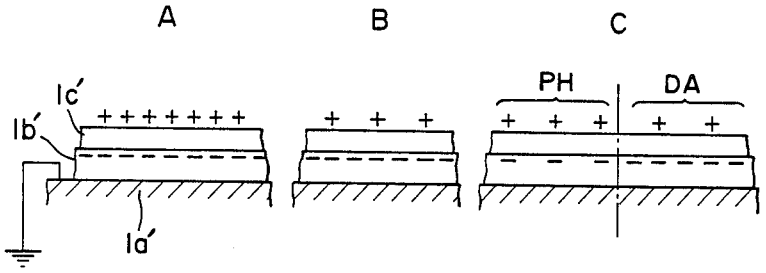
FIGS. 16 and 17 are views showing the steps of forming an electrostatic image in the multi-color image forming apparatus of FIG. 15.
Figure 17:
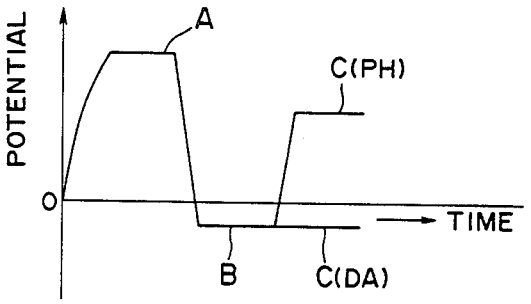

In this recording apparatus, if the image forming member 1' having its charges eliminated has its surface charged by means of the corona discharger while being irradiated with the exposing lamp of the primary charging device 32 (although this irradiation may be omitted as the case may be, as has been stated hereinbefore), it is its photoconductive photosensitive layer 1'b and transparent insulating surface layer 1'c have their surface and inner side charged, as shown at A in FIG. 16. If the image forming member 1' thus charged has its surface subjected to the corona discharge by the secondary charging device 33, then only the charges on the surface of the transparent insulating surface layer 1'c are reduced, because the photoconductive photosensitive layer 1'b has the insulating characteristics, so that the charges of the photosensitive member 1' change, as shown at B in FIG. 16. If the image exposing ray is incident upon the surface of the photosensitive member 1' thus secondarily charged, the surface charges of the photoconductive photosensitive layer 1'b at the exposed part PH are reduced whereas the charges are left as they were at the non-exposed part DA so that the charges of the image forming member 1' vary, as shown at C in FIG. 16. The interim changes of the surface potential of the photosensitive member 1' are shown in FIG. 17, in which the potentials in the states A, B and C correspond to the charged states A, B and C of FIG. 16, respectively. More specifically, the potential of the exposed part PH on which the image exposing ray was incident has a surface potential, as shown at C(PH) in FIG. 17, whereas the potential of the unexposed part DA on which the image exposing ray was not incident has substantially the same surface potential C(DA), as shown at B in FIG. 17, so that the electrostatic image of the surface potential indicated at C(PH) is formed by the image exposing ray with respect to that background potential. This electrostatic image can be developed by the coulomb attraction, like the usual electrophotographic copying machine, with the developer for charging the unexposed part DA to a polarity opposite to that of the latent image. Reference numeral 1'a indicates a conductive substrate which is made of aluminum or the like.

The present invention will be described in the following in connection with its experimental examples using the apparatus described above.

[Experimental Example 1]

The experiments forming full-color images were conducted with the apparatus of FIG. 5 and charging the developing devices A to C with the yellow, magenta and cyan toners having the spectral absorptions shown in FIG. 13. The photosensitive member used had the photosensitive layer of Se and the circumferential speed of 180 nm/sec.

The surface of the image forming member 1 is charged to +500 V by means of the charging device 2 using the Scolotron corona discharger, and the charged surface was subjected to a first exposure in a density of 16 spots/mm by means of the laser beam scanner of FIG. 14 using the He-Ne laser having the wavelength of 632.8 nm. The exposing intensity was 2 to 20 times as high as the half exposure (i.e., the exposure required for reducing the potential of the photosensitive member to one half) so as to cause sufficient potential drop of the photosensitive member.

As a result, the image forming member 1 was formed with the electrostatic image having the exposed part potential of +30 V with respect to the background potential of +500 V. The resultant electrostatic image was subjected to a first reversal development by means of the developing device A shown in FIG. 6.

This developing device A used the developer composed of both the carrier, which contained 50 wt. % of magnetite dispersed in a resin and which had an average particle diameter of 30 microns, a magneticism of 30 emu/g and a resistivity of $10^{14}$ ohms-cm or more, and the nonmagnetic toner, which was prepared to have an average particle diameter of 10 microns by adding 15 wt. parts of quinaphthalon as the yellow pigment and another charge controlling agent to stylene-acryl resin, under the condition that the ratio of the toner in the developer was 20% by weight. Moreover, the non-contact developing conditions were followed: the developing sleeve 11 had the external diameter of 30 mm and revolutions of 100 r.p.m.; the magnet 12 had the density of the magnetic flux of 1,000 gausses for the N and S magnetic poles and revolutions of 1,000 r.p.m.; the developer layer in the developing range had a thickness of 0.8 mm; the gap between the developing sleeve 11 and the photosensitive member 1 was 0.8 mm; and the superposed voltage of a d.c. voltage of +400 V and an a.c. voltage of 1.5 KHz and 1,000 V was applied to the developing sleeve 11.

While the developing device A was developing the electrostatic image, the remaining similar developing devices B and C shown in FIG. 6 were held in a state other than the developing state. This was achieved by disconnecting the developing sleeve 11 from a power supply 30 into the floating state, by grounding the same, or by applying the d.c. bias voltage of a polarity opposite to the charge of the image forming member 1, i.e., the charge of the toner positive to the developing sleeve 11. Of these, it was preferred to apply the d.c. bias voltage. Since the developing devices B and C were used for the non-contact developing conditions like the developing device A, the developing sleeve 11 need not be especially cleared off the developer layer. This developing device B used developer, which was prepared such that the toner of the developing device A had its yellow pigment replaced by an azolake pigment as the magenta pigment, and the developing device C used the developer which was prepared such that the toner of the same had its cyan pigment replaced by the copper phthalocyanine. It is quite natural that the color toners used may contain another pigment or dye.

The surface of the photosensitive member 1 having been subjected to the first development was exposed to a pretransfer exposing lamp 9' (which might be omitted) and was then subjected at the second turn to a second charging to +500 V by means of the charging device 2 without using the charge eliminating device 7 and the cleaning device. Then, the photosensitive member surface was subjected to a second image exposure in the superposed spot position and in the same spot density by means of the same laser beam scanner. The surface thus twice exposed was then subjected to a second development of the magenta toner by means of the developing device B. Likewise, the third development with the cyan toner by the developing device C was repeated. At to the aforementioned respective developments, incidentally, the d.c. bias component and the amplitude and frequency of the a.c. bias component of the voltage applied to the developing sleeve 11, and the selecting time of the time selecting conversion could be suitably changed to adjust the developed densities of the respective colors in conformity to the changes in the surface potential, the developing characteristics and the color reproductivity of the image forming member 1.

When the third development was conducted so that the trichromatic color image was formed on the photosensitive member 1, that image was made liable to be transferred by means of the pretransfer charging device 9 or the pretransfer exposing lamp 9' so that it was transferred to the recording member P by the transferring device 4 until it is fixed by means of the fixing device 6. The photosensitive member 1 to which the color image was transferred was statically eliminated by the charge eliminating device 7 and was cleared of the residual toner from its surface by the abutting actions of the cleaning blade or fur brush of the cleaning device 8. The one-cycle steps for forming the multi-color image were ended completely at the instant when the surface having been formed with the color image passed over the cleaning device 8.

The color image thus recorded had a high density of spot picture elements and had its pattern expressed finely.

The color mixing according to the present Experimental example is of the subtracting type. On the contrary, there is known the adding color mixing method in which the spot positions are shifted for the respective colors. When the latter method is used, the writing accuracy required is remarkably high and is difficult at high density. The method of the present invention is also effective for adding color mixing. In this case, even if the writing positional accuracy is so insufficient that the reducing color-mixed part is formed in the adding color-mixed part in which spots of different colors are partially superposed, or even if an intermediate state of the reducing and adding color mixings is intentionally established for the high density, the color balance can be held to an ideal level because of the advantage that the toner images are superposed.

[Experimental Example 2]

The recording apparatus of FIG. 15 was used. The photosensitive member 1' was prepared such that a transparent insulating layer having a thickness of 20 microns was formed on a photosensitive layer of CdS having a thickness of 30 microns and its long wavelength sensitized, and had a circumferential speed of 180 m/sec. This image forming member 1' was subjected to a primary charge to have a surface potential of +1,500 V by means of a d.c. Scolotron corona discharge device while being exposed uniformly by means of the exposing lamp of the primary charging device 32. Next, the image forming member 1' was charged to have a surface potential of −500 V by means of the secondary charging device 33 which is constructed of the Scolotron corona discharge device having an a.c. component. This charged surface was exposed to a multi-color document image through a blue filter having a spectral transmissivity peak of 450 nm, as shown by a curve (B) in FIG. 13, to form an electrostatic image which exhibited the potential of −500 V with respect to the white background of +200 V. This electrostatic image was developed by means of the developing device A, which was charged with yellow toner, while the a.c. voltage of 1.5 KHz and 1,000 V containing a d.c. component of −50 V was being applied to the developing sleeve 11. The remaining developing conditions were identical to those of the Experimental Example 1. The surface of the photosensitive member 1' having been subjected to the first development was exposed to a pretransfer exposing lamp 9' (which may be omitted). Without operating the charge eliminating device 7 and the cleaning device 8, on the other hand, the charge was conducted again at the second turn of the photosensitive member 1' by means of the primary charging device 32 and the secondary charging device 33, and the second exposure was conducted through the green filter having the spectral transmissivity peak of 540 nm, as shown by the curve (G) in FIG. 13. The second development was conducted by the developing device B which was charged with the magenta toner. The developing conditions were made identical to those of the first development. Next, the image having three color toners superposed was formed by conducting the third charging operation, the exposure through the red filter having a transmissivity peak of 630 nm, as shown at (R) in FIG. 13, and the development by the developing device C charged with the cyan toner. The resultant image was transferred to the recording member P and fixed to form multi-color copy similar to that of Experimental Example 1.

In this Example, the density adjustment of the multicolor image formed could be made more easily than the case of the Experimental Example 1 which resorted to the developing method for causing the electrostatic image to trap the toner of the same polarity as that of that image. The multi-color image thus recorded had an excellent color tone as that obtained in the Experimental Example 1.

According to the embodiments of the present invention, the toner images copied can be formed in a superposed manner, as desired, by using for the image exposure the ray which has such a spectral distribution as is little absorbed by the toner image formed already on the photosensitive member. As a result, in the recording apparatus such as the laser printer, the image spot density can be increased to record a fine multi-color image. In the usual color copying machine or the like, moreover, an excellent color image can be recorded. Since the electrostatic image is formed by a common apparatus, there excellent effects can be attained in that the recording apparatus which is produced is small and relatively cheap, and in that synchronous control of the image exposing ray with the image forming member can be easily effect.

The present invention can also be applied to either the case, in which the image forming member has a shape of a belt or sheet or the case in which the image forming member is attached to the substrate such as electrofax paper and in which the color image of a toner formed thereon is fixed without being transferred. On the other hand, the transfer may be not only corona transfer but also bias roller transfer, adhesive transfer or pressure transfer through an intermediate transferring member. It is quite natural that fixing should not be limited to heat roller fixing.

The method of the present invention exemplified by the Experimental Example 2 has a great advantage that the polarities of the potentials of the image part and non-image part can be reversed in dependence upon the balance in the intensities of the primary and secondary charging operations. The development can naturally be effected by making the polarities identical and by changing the developing bias conditions. Moreover, the NP method or the KIP method can naturally be applied to the method of the present invention.

What is claimed is:

1. A multicolor image forming method comprising forming a first latent image by uniformly charging an image retainer having a photosensitive layer and exposing said first latent image using a first light, forming a first toner image by developing said first latent image with a dry type first color toner, forming a second latent image by uniformly re-charging said image retainer in the presence of said first toner image and exposing the second image using a second light having a peak wavelength in a wavelength range wherein a spectral reflectivity of said first toner is at least 40%, and developing said second latent image with a dry type second color toner by providing a second toner layer close to said first toner image in a developing region.

2. The method of claim 1 further comprising forming a third latent image by uniformly re-charging said image retainer in the presence of said first and second toner images and exposing a third image using a third light having a peak wavelength in a wavelength range wherein the spectral reflectivities of said first and second toners are at least 40%, and developing said third latent image with a dry type third color toner by providing a third toner layer close to said first and second toner images in a developing region.

3. The image forming method of claim 1 wherein said first light and said second light are laser beams.

4. The method of claim 2 wherein said first light, said second light, and said third light are laser beams.

5. A multicolor image forming method comprising forming a first latent image by uniformly charging an image retainer having a photosensitive layer and exposing said first latent image using a first light, forming a first toner image by developing said first latent image with a dry type first color toner, forming a second latent image by uniformly re-charging said image retainer in the presence of said first toner image and exposing the second image using a second light having a peak wavelength in a wavelength range wherein a spectral reflectivity of said first toner is at least 40%, and developing said second latent image with a dry type second color toner by applying a developing bias comprising an oscillating component in said region.

6. The method of claim 5 further comprising forming a third latent image by uniformly re-charging said image retainer in the presence of said first and second toner images and exposing a third image using a third light having a peak wavelength in a wavelength range wherein spectral reflectivity of said first and second toners are at least 40%, and developing said third latent image with a dry type third color toner by applying a developing bias comprising an oscillating component in said region.

7. The method of claim 6 further comprising transferring said first, second and third toner images to a paper.

8. The method of claim 6 wherein said first, second and third lights are blue, green and red, respectively.

9. The method of claim 8 wherein said first, second and third color toners are yellow, magenta and cyan, respectively.

10. A multicolor image forming method comprising forming a first latent image by uniformly charging an image retainer having a photosensitive layer and exposing a first image using a laser beam light, forming a first toner image by developing said first latent image with a dry type first color toner, forming a second latent image by uniformly re-charging said image retainer in the presence of said first toner image and exposing a second image using said laser beam light having a peak wavelength in a wavelength range wherein a spectral reflectivity of said first toner is at least 40% and developing said second latent image with a dry type color type by applying a developing bias comprising an oscillating component in said region.

11. The method of claim 10 further comprising forming a third latent image by uniformly re-charging said image retainer in the presence of said first and second toner images and exposing a third image using said laser beam light wherein said peak wavelength is within a wavelength range in which a spectral reflectivity of said second toner is at least 40% and developing said third latent image with a dry type third color toner by applying a developing bias comprising an oscillating component in said region.

12. The method of claim 11 further comprising transferring said first, second and third toner images to a paper.

13. The method of claim 11 wherein said first, second and third color toners are yellow, magenta and cyan, respectively.

14. A multicolor image forming method comprising forming a first latent image by uniformly charging an image retainer having a photosensitive layer and exposing a first image using a LED, forming a first toner image by developing said first latent image with a dry type first color toner, forming a second latent image by uniformly re-charging said image retainer in the presence of said first toner image and exposing a second image using LED having a peak wavelength in a wavelength range wherein a spectral reflectivity of said first toner is at least 40%, and developing said second latent image with a dry type second color toner by providing a second toner layer close to said first toner image in a developing region.

15. The method of claim 14 further comprising forming a third latent image by uniformly re-charging said image retainer in the presence of said first and second toner images and exposing a third image using said LED wherein said peak wavelength is within a wavelength range in which a spectral reflectivity of said second toner is at least 40%, and developing said third latent image with a dry type third color toner by applying a developing bias comprising an oscillating component in said region.

16. The method of claim 15 further comprising transferring said first, second and third toner images to a paper.

17. The method of claim 15 wherein said first, second and third color toners are yellow.

18. A multicolor image forming method comprising forming a first latent image by uniformly charging an image retainer having a photosensitive layer and exposing a first image using a LED, forming a first toner image by developing said first latent image with a dry type first color toner, forming a second latent image by uniformly re-charging said image retainer in the presence of said first toner image and exposing a second image using said LED having a peak wavelength in a wavelength range wherein a spectral reflectivity of said first toner is at least 40% and developing said second latent image with a dry type color type by applying a developing bias comprising an oscillating component in said region.

19. The method of claim 18 further comprising forming a third latent image by uniformly re-charging said image retainer in the presence of said first and second toner images and exposing a third image using said LED wherein said peak wavelength is within a wavelength range in which a spectral reflectivity of said second toner is at least 40% and developing said third latent image with a dry type third color toner by applying a developing bias comprising an oscillating component in said region.

20. The method of claim 19 further comprising transferring said first, second and third toner images to a paper.

21. The method of claim 19 wherein said first, second third color toners are yellow, magenta and cyan, respectively.

22. The method of claim 2 wherein at least one of said first, second and third lights is controlled by a liquid crystal shutter.

23. The method of claim 6 wherein at least one of said first, second and third lights is controlled by a liquid crystal shutter.

24. The method of claim 23 further comprising transferring said first, second and third toner images to a paper.

25. The method of claim 23 wherein said first, second and third lights are blue, green and red, respectively.

26. The method of claim 25 wherein said first, second and third color toners are yellow, magenta and cyan, respectively.

27. The method of claim 4 further comprising transferring said first, second and third toner images to a paper.

28. The method of claim 4 wherein said first, second and third color toners are yellow, magenta and cyan, respectively.

* * * * *